US005727953A

United States Patent [19]

Pasholk

[11] Patent Number: 5,727,953

[45] Date of Patent: Mar. 17, 1998

[54] NITE LITE WITH ROTATABLE PRONGS

[75] Inventor: Daniel Pasholk, Montgomery, Ill.

[73] Assignee: BRK Brands, Inc., Aurora, Ill.

[21] Appl. No.: 690,555

[22] Filed: Jul. 31, 1996

[51] Int. Cl.[6] ..... H01R 39/00

[52] U.S. Cl. ..... 439/21; 439/365

[58] Field of Search ..... 439/11, 446, 362, 439/365, 21

[56] References Cited

U.S. PATENT DOCUMENTS

| | | | |
|---|---|---|---|
| Re. 34,693 | 8/1994 | Plocek et al. . | |
| 1,631,575 | 6/1927 | Berry . | |
| 2,166,790 | 7/1939 | Benaner . | |
| 2,542,935 | 2/1951 | McElroy . | |
| 2,570,784 | 10/1951 | Ferguson . | |
| 2,841,695 | 7/1958 | Bensten . | |
| 3,092,695 | 6/1963 | Abrams | 439/11 |
| 3,161,450 | 12/1964 | Goodenough | 439/362 |
| 3,203,126 | 8/1965 | Eliot . | |
| 3,430,180 | 2/1969 | Brown . | |
| 3,706,004 | 12/1972 | Schwartz . | |
| 4,583,798 | 4/1986 | Blazowich . | |
| 4,654,557 | 3/1987 | Haraden . | |
| 5,082,448 | 1/1992 | Kang . | |
| 5,399,093 | 3/1995 | Schneider et al. . | |

*Primary Examiner*—Neil Abrams
*Assistant Examiner*—Christopher Goins
*Attorney, Agent, or Firm*—Dressler, Rockey, Milnamow & Katz, Ltd.

[57] ABSTRACT

A safe, rotatable AC powered night light includes a retaining tab which is attached adjacent to standard AC prongs. The retaining tab can be screwed via a face plate, to a pair of standard AC receptacles thereby attaching the light to the receptacle. The light can be rotated relative to the receptacles when attached thereto. Removal of the light requires removal of the retaining screw which extends through the retaining tab into a threaded hole between the receptacles.

16 Claims, 5 Drawing Sheets

NITE LITE WITH ROTATABLE PRONGS

FIELD OF THE INVENTION

The invention pertains to night lights having safety features. More particularly, the invention pertains to night lights having rotatable prongs as well as well structures for attachment to AC receptacles.

BACKGROUND OF THE INVENTION

Night lights have long been recognized as being useful in providing low levels of light in children's rooms, hallways and similar areas at night. Known night lights function automatically and turn on at dusk and then turn off at day break in response to incident daylight.

Night lights are also known with rotatable prongs. The ability to rotate a portion of the light, relative to the prongs, is especially convenient and desirable given that receptacles have various orientations relative to the floor. Some of the known night lights with rotatable prongs teach the use of screws or rivets located at the center of rotation of the prongs for the purpose of rotatably connecting the prongs to the body of the night light.

It is also well known that children are very curious and at times are drawn to lighted objects. Thus, there continues to be a need for night lights which not only incorporate rotatable prongs, but which cannot readily be extracted from an adjacent AC receptacle. Preferably, such night lights could provide such removal resistant characteristics without having to substantially increase the cost of the light.

SUMMARY OF THE INVENTION

A night light which embodies the present invention incorporates a set of AC prongs which are rotatably coupled to the body of a night light. The night light body carries a low level source of illumination along with a radiant energy detector. In the absence of radiant energy, such as daylight, electrical energy received via the rotatable prongs automatically energizes the light carried on the body.

The rotatable prongs, in one aspect of the invention, are rotatably coupled to the body by a snap-fit arrangement. This permits the prongs to be readily assembled for rotary movement with respect to the body without any need for additional screws, rivets or the like.

In yet another aspect of the invention, a tab can be provided adjacent to the prongs for fastening the prongs to the receptacle. In one embodiment of the invention, the prongs can be screwed to the receptacle by means of the same screw which holds the face plate on the receptacle. That screw passes through a hole in the tab and attaches the tab, the prongs and the rest of the light directly to the receptacles. With this arrangement, the body is still free to rotate so that a preferred orientation of the light can be provided.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE PREFERRED EMBODIMENTS

Figure 1:
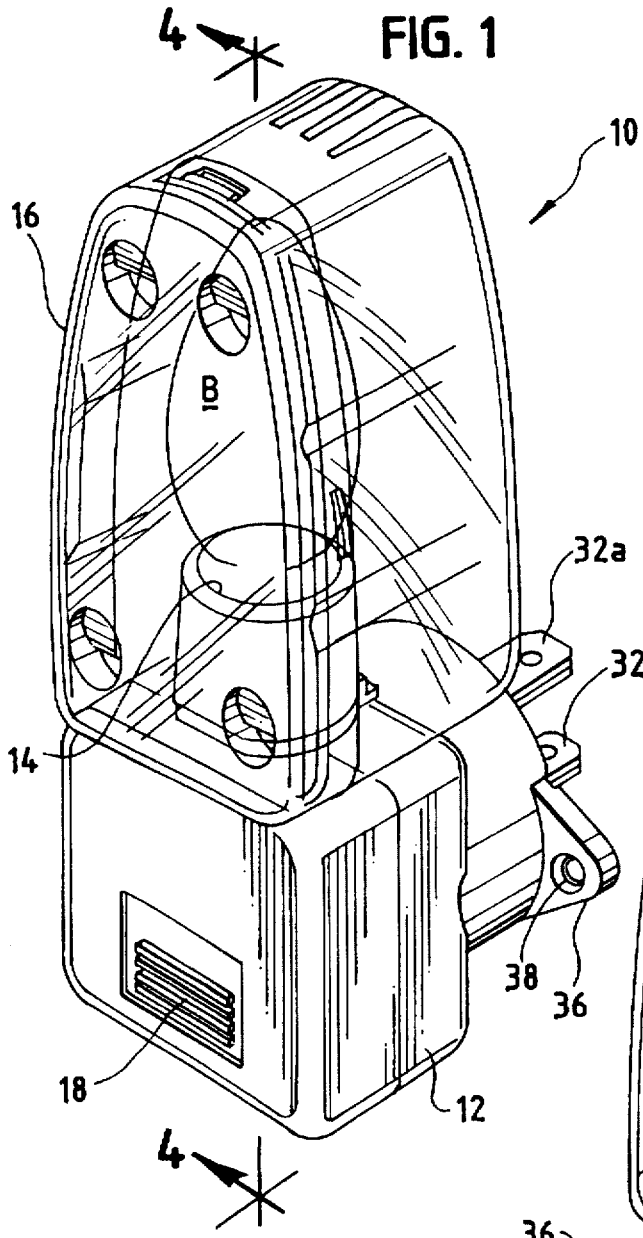
FIG. 1 is a front perspective view of a night light in accordance with the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Figure 2:
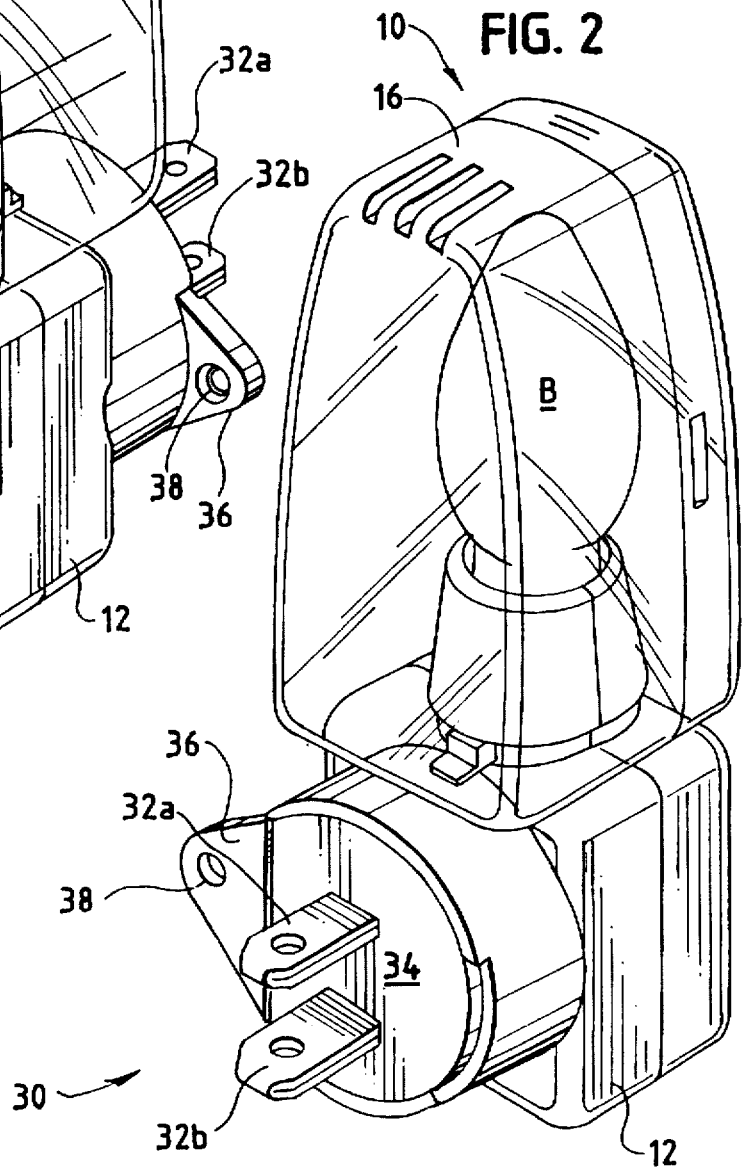
FIG. 2 is a rear perspective view of the night light of FIG. 1.

FIGS. 1 and 2 are overall perspective views of a night light 10 in accordance with the present invention. The night light 10 includes a body portion 12 which carries a socket 14. The socket 14 rotatably receives a low wattage bulb B.

The housing 12 also carries a lens or cover 16. It will be understood that the lens or cover 16 could assume a variety of shapes and appearances without departing from the spirit and scope of the present invention. In one aspect of the invention, the cover 16 is slidably coupled to the housing 12. With this arrangement, the lens 16 can be removed for purposes of replacing the bulb B or for installing a different, perhaps decorative, cover as a replacement.

The housing 12 also carries an input lens 18 which receives incident radiant energy, day light for example, for the purpose of enabling the night light 10 to automatically turn and off at dusk and at dawn. Carried within the housing 12 is a photosensor, not illustrated, which is responsive to the incident day light for the purpose of permitting the bulb B to be automatically energized between dusk and dawn.

The housing 12 also carries a set of prongs generally indicated at 30 rotatably coupled thereto. The prongs include first and second elongated rigid metal elements 32*a*, 32*b* of a conventional shape and size for slidably engaging standard AC utility-type receptacles.

The prongs 32*a*, 32*b* extend from a planar base member 34. The member 34 along with the prongs 32*a*, 32*b* are rotatably coupled to the housing 12 so that when the prongs are inserted into a receptacle, the housing 12 and bulb B can be rotated to a selected orientation relative to the receptacle.

The prong structure 30 also carries an attachment safety tab 36 which extends from the base element 34. The tab 36 carries a boring 38.

When the night light 10 is to be installed, a screw located between conventional AC receptacles, normally use to hold the face plate against the receptacles, is removed and the boring 38 lined up with the opening in the face plate. The screw is then replaced. It extends through the opening 38, through the face plate and into the receptacle for the purpose of securely attaching the night light 10 to the receptacle.

With the above described arrangement, the night light 10 cannot be removed accidently or mischievously without first removing the retaining screw which extends through the opening 38 into the threaded opening between the receptacles. Also with this arrangement, the body 12 can still be rotated relative to the prongs 32*a*, 32*b* to align the bulb B in a preferred orientation.

Figure 3:
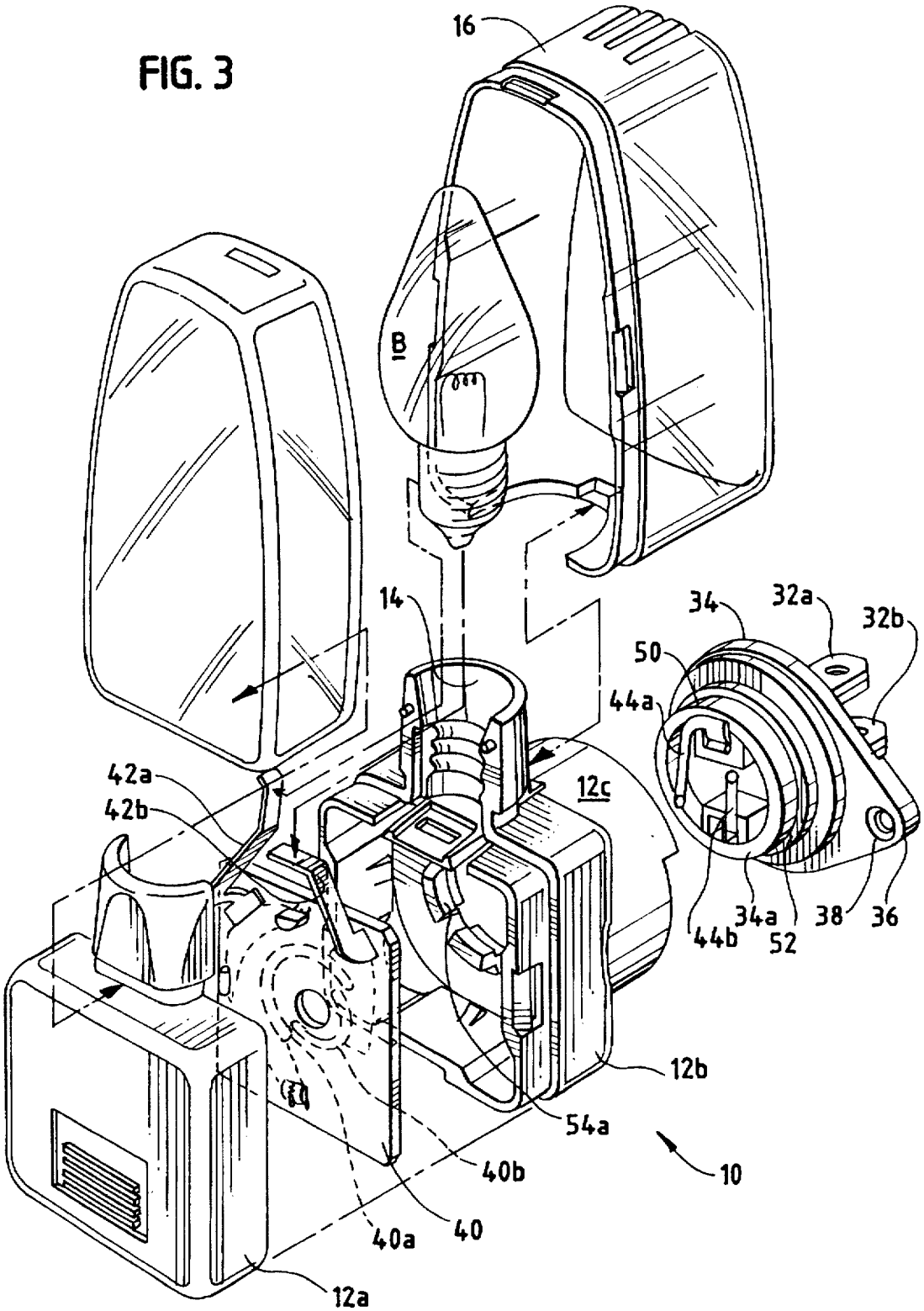
FIG. 3 is an exploded perspective view of a night light in accordance with the present invention.

FIG. 3, an exploded perspective view illustrates various details of the night light 10. The housing 12 is formed in one embodiment with first and second sections 12*a*, 12*b* which slidably engage one another during manufacture.

The sections 12*a*, 12*b* carry therein a printed circuit board 40 which carries various conductors which are coupled by conductive elements 42*a*, 42*b* to socket 14 which rotatably receives the bulb B. The housing 12 also carries a hollow cylindrical extension or barrel 12*c* which slidably receives a cylindrical protusion 34*a* carried on the base 34. The protusion 34*a* rotatably engages the cylindrical extension 12*c* with a snap-fit during assembly.

Each of the prongs 32*a*, 32*b* is coupled to a respective conductor 44*a*, 44*b*. The conductors 44*a*, 44*b* slidably engage arcuate printed conductors 40*a*, 40*b* carry on the printed circuit board 40.

When the cylindrical protusion 34*a*, is snap-fit into the cylindrical extension 12*c*, conductor 44*a* slidably engages conductive path 40*a* which is in mm electrically connected to conductor 42*a*. Similarly, conductor 44*b* slidably engages arcuate path 40*b* which is in turn electrically connected to conductor 42*b*. Thus, electrical energy received via the prongs 32*a*, 32*b* is connected to the conductors 42*a*, 42*b* which in mm are coupled to the base of the bulb B to energize same.

As the housing 12 and the bulb B are rotated relative to the prongs 32*a*, 32*b*, the conductors 44*a*, 44*b* slide along the arcuate fixed conductors 40*a*, 40*b* on the printed circuit board 40. Thus, the prongs 32*a*, 32*b* continuously maintain electrical contact with the base of the bulb B energizing same irrespective of the orientation of the housing 12 relative to those prongs.

FIGS. 4–7 illustrate further details of the engagement of the cylindrical protusion 34*a* with the extension 12*c*. As is illustrated therein, the extension 34*a* carries an annular flange 50 which is positioned adjacent to an annular slot 52.

Figure 4:
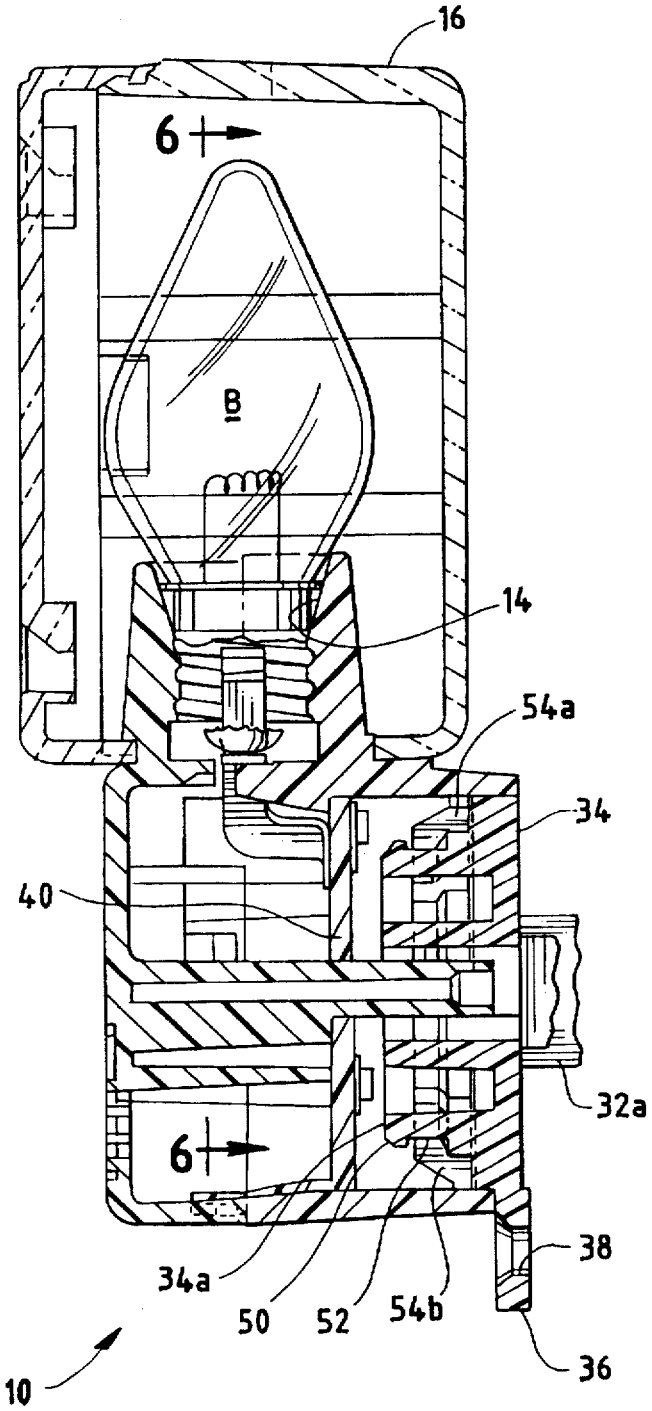
FIG. 4 is a sectional view taken along plane 4—4 of FIG. 1.
Figure 5:
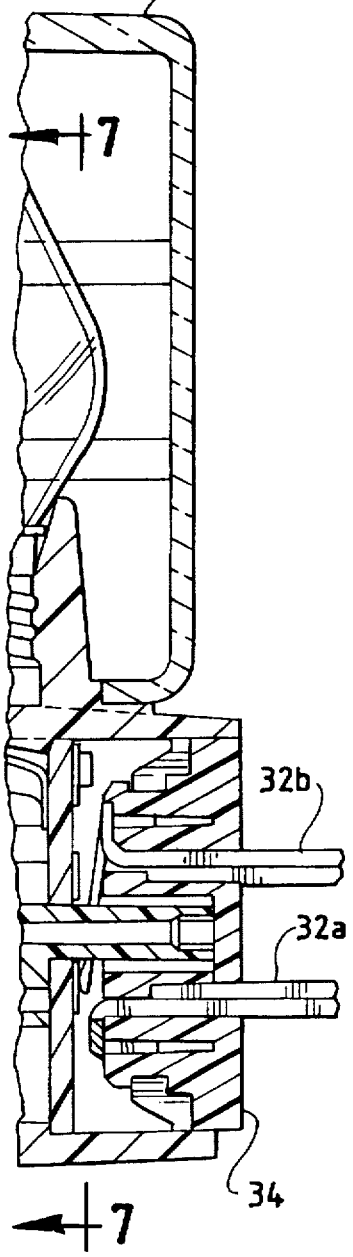
FIG. 5 is a fragmentary sectional view as in FIG. 4 with the AC prongs rotated to a different orientation.
Figure 6:
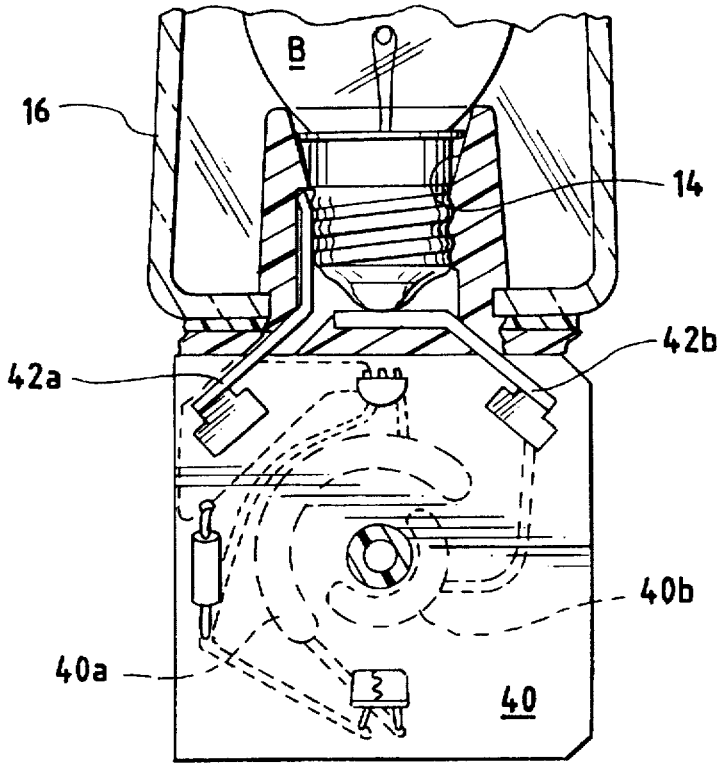
FIG. 6 is a sectional view taken along plane 6—6 of FIG. 4.
Figure 7:
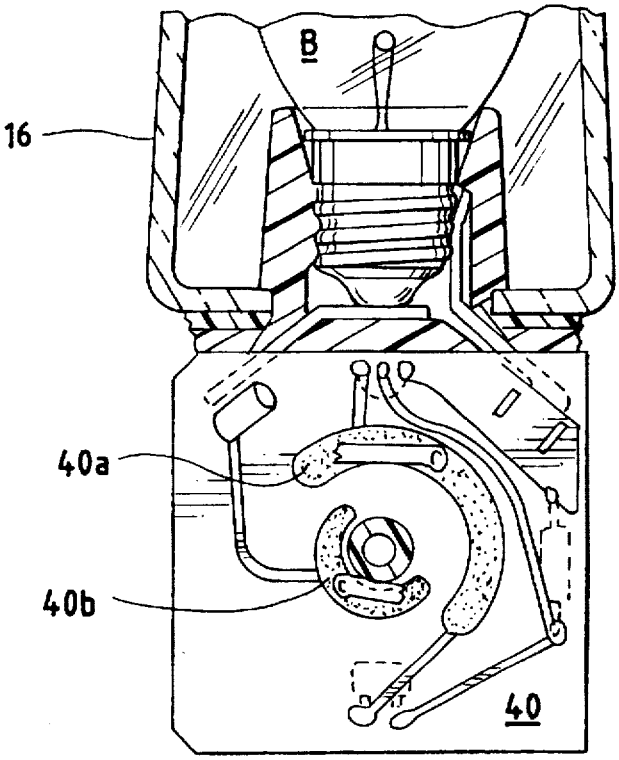
FIG. 7 is a sectional view taken along plane 7—7 of FIG. 5.

When the prong structure 30 is slid into the cylindrical extension 12*c*, deflectable retaining members, such as members 54*a*, 54*b* (on the extension 12*c*) slidably and deformedly engage the annular flange 50 permitting the annular flange to slide past same as illustrated in FIG. 4. The retaining elements 54*a*, 54 are somewhat deflectable and permit the annular ring 50 to slide therepast where upon those retaining elements return to their original position and slidably engage the surfaces of the slot 52.

The retaining elements 54*a*, 54*b* block the cylindrical protusion 34*a* from moving linerally due to the interaction between the annular flange 50 and the retaining members 54*a*, 54*b* which slidably engage the slot 52. Hence, the prongs 32*a*, 32*b* can be rotated relative to the body 12 but not removed therefrom.

Figure 8:
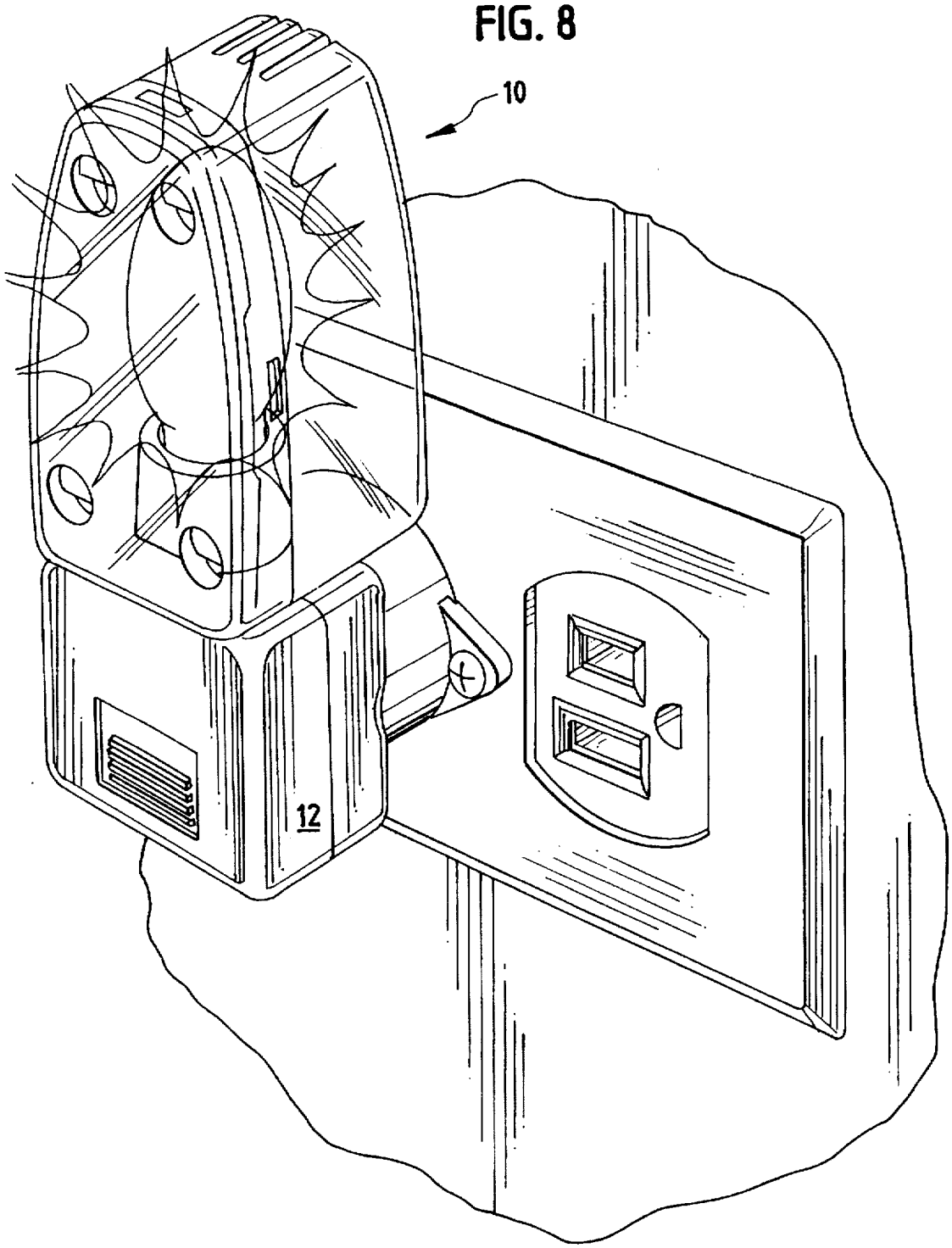
FIG. 8 is a perspective view of the nite lite of FIG. 1 attached to an AC receptacle.

FIG. 8 illustrates the nite lite 10 plugged into a receptacle. the same screw that retains the face plate is used to attach the lite 10 thereto.

From the foregoing, it will be observed that numerous variations and modifications may be effected without departing from the spirit and scope of the invention. It is to be understood that no limitation with respect to the specific apparatus illustrated herein in tended or should be inferred. It is, of course, intended to cover by the appended claims all such modifications as fall within the scope of the claims.

What is claimed is:

1. A rotatable night light comprising:

a body having a socket for receiving a light bulb;

first and second AC prongs, and a base, said prongs extending from said base, and wherein said base includes a protrusion which slidably engages the body and is rotatably retained thereby;

a retaining element having a tab extending from said base for fixedly attaching the tab to a structure of an adjacent source of electrical energy.

2. A night light as in claim 1 wherein the retaining element includes a boring for receipt of a cylindrical retaining element intended to rotatably engage an adjacent AC receptacle.

3. A fight light as in claim 1, wherein said protusion comprises a cylindrical element having an annular locking flange which snap-fittingly engages a plurality of locking elements carried by the body.

4. A night light as in claim 1, wherein the prongs extend at least partially through said protrusion.

5. A night light as in claim 1, wherein the body includes at least one arcuate conductor electrically connectable to a light bulb carried by said socket; and a corresponding conductor connected to one of said prongs and slidingly electrically connected to said arcuate conductor.

6. A night light as in claim 5, further comprising a photosensor for electrically disconnecting the adjacent source of electrical energy from the socket.

7. A night light as in claim 1, wherein said tab includes a bore for attaching said tab to a face plate of an AC outlet.

8. A night light as in claim 7, wherein said protrusion is cylindrical and said body includes a hollow cylindrical barrel for receiving said protrusion rotatably therein.

9. A night light as in claim 8, wherein the prongs extend at least partially through said protrusion.

10. A night light as in claim 9, wherein the body includes arcuate conductors electrically connectable to a light bulb carried by said socket; and corresponding conductors connected to said prongs and slidingly electrically connected to said arcuate conductors.

11. A night light as in claim 10, further comprising a photosensor for electrically disconnecting the adjacent source of electrical energy from the socket.

12. A night light as in claim 1, wherein said protusion is cylindrical and said body includes a hollow cylindrical barrel for receiving said protusion rotatably therein.

13. A rotatable light which can be attached to an electrical source comprising:

a body which carries at least one arcuate conductor;

a light socket carried by the body and coupled to the conductor;

a prong carrying portion which rotatably and snap-fittingly engages the body wherein first and second prongs extend therefrom, wherein one of the prongs is in continuous electrical contact with the arcuate conductor as the prongs are rotated relative to the body; and a retaining element carried by the portion wherein the element is adapted to be fixedly coupled to the source.

14. A light as in claim 13 wherein the housing carries a second arcuate conductor coupled to the light socket and to the other of the prongs.

15. A light as in claim 14 wherein the prongs extend generally perpendicular to an axis of the symmetry of the light socket.

16. A night light as in claim 5 wherein the body includes a further arcuate conductor electrically connectable to a light bulb carried by said socket; and a corresponding further conductor connected to another of said prongs and slidably electrically connected to said further arcuate conductor.

* * * * *

UNITED STATES PATENT AND TRADEMARK OFFICE

CERTIFICATE OF CORRECTION

PATENT NO. : 5,727,953

DATED : March 17, 1998

INVENTOR(S): Daniel Pasholk

It is hereby certified that error appear(s) in the above-identified patent and that said Letters Patent is hereby corrected as shown below:

Col. 3, line 27, "mm" should be --turn--;

Col. 3, line 32, "mm" should be --turn--;

Col. 3, line 62, "the", first occurrence, should be --The--;

Col. 4, line 1, "in tended" should be --intended--;

Col. 4, line 18, "fight" should be --night--.

Signed and Sealed this

Eleventh Day of May, 1999

*Attest:*

Q. TODD DICKINSON

*Attesting Officer*

*Acting Commissioner of Patents and Trademarks*